US006755752B2

(12) United States Patent
Shimizu et al.

(10) Patent No.: US 6,755,752 B2
(45) Date of Patent: Jun. 29, 2004

(54) GOLF CLUB ADJUSTING TOOL, GOLF CLUB AND GOLF CLUB ADJUSTING METHOD

(75) Inventors: Sadatsugu Shimizu, Niigata (JP); Ikuo Nakazawa, Niigata (JP)

(73) Assignee: Sovic (JP)

( * ) Notice: Subject to any disclaimer, the term of this patent is extended or adjusted under 35 U.S.C. 154(b) by 0 days.

(21) Appl. No.: 10/285,629

(22) Filed: Nov. 1, 2002

(65) Prior Publication Data

US 2003/0083146 A1 May 1, 2003

(30) Foreign Application Priority Data

Nov. 1, 2001 (JP) ..... 2001-336309

(51) Int. Cl.[7] ..... A63B 53/08
(52) U.S. Cl. ..... 473/318
(58) Field of Search ..... 473/316–323, 473/520–523, 564

(56) References Cited

U.S. PATENT DOCUMENTS 5,692,971 A * 12/1997 Williams ..... 473/318
5,851,157 A 12/1998 Koide et al.
6,042,484 A * 3/2000 Streit ..... 473/282

FOREIGN PATENT DOCUMENTS

JP 5-48140 7/1993
JP 2000-61014 2/2000

* cited by examiner

*Primary Examiner*—Stephen Blau
(74) *Attorney, Agent, or Firm*—Connolly Boye Lodge & Hutz LLP

(57) ABSTRACT

In order to provide an adjusting tool for a golf club to enhance directionability or a driving distance with a flex characteristics of a shaft which is suitable for the taste of a player, there is provided a golf club adjusting tool for adjusting feeling of a golf club in use, characterized by comprising: a fixed portion coupled and fixed in contact with a shaft portion of the golf club in the contact range of 5 to 40 mm in a longitudinal direction; and a vibration absorbing portion projecting in the longitudinal direction of the shaft portion continuously with the fixed portion and out of contact with the shaft portion.

8 Claims, 5 Drawing Sheets

GOLF CLUB ADJUSTING TOOL, GOLF CLUB AND GOLF CLUB ADJUSTING METHOD

BACKGROUND OF THE INVENTION

1. Field of the Invention

The present invention relates to a golf club adjusting tool which may readily adjust use feeling such as flexibility or rigidity feeling of a shaft, a golf club on which the adjusting tool is mounted and an adjusting method for determining a mounting position of the adjusting tool.

2. Description of the Related Art

A shaft portion of a golf club is formed so as to be flexible or rigid suitably for an effective shot when the golf club hits a ball through a swing. The magnitude of the flexibility or rigidity and the position of the flexion (distal flexion feeling or proximal flexion feeling) are determined in conformity with a taste of the player or the ability of the player (the effectiveness of the wrists upon the hit or the swing speed).

The rigidity characteristics are variously changed depending upon a material, a structure, a length or the like of the shaft portion. Japanese examined patent publication No. Hei 5-48140 discloses a method for matching the rigidity for a player, in which a barrel-shaped core member having a central portion with a greater diameter and a tapered top portion and a tapered bottom portion both having a gradually smaller diameter is provided in an interior of the shaft portion. Namely, the central portion of the core member is in contact with an inner surface of the shaft portion with an interval to the shaft inner surface at the front and rear portions of the contact portion whereby the flexion of the shaft portion per se eliminates the above-described interval and the collision of the shaft portion with the core member restricts the flexion of the shaft portion.

Accordingly, the adjustment of the flexibility by using the conventional core member (adjusting member) is simply intended to adjust the limit position of the flexibility of the shaft portion and the range of the restriction (a size of the interval). For this reason, the adjustment of the strength for generating the flexion is limited only to the material of the shaft portion per se and could not cope with a delicate demand of an individual for the flexibility characteristics.

Accordingly, the present inventor has proposed to use an adjusting member which is a cylindrical member press-fitted within the shaft portion and having such a length that the flexion of the shaft portion is sufficiently affected, in which a plurality of vertical slits are formed at a uniform adjacent interval from upper and lower openings of the cylindrical member except for the intermediate portion thereof and which is fixed at the intermediate portion having no cut to a suitable position within the shaft portion (JP 2000-61014A).

After the studies by the present inventor, it has been found that there is a delicate vibration of a head weight transmitted to hands even during the swing back and the forward swing, of course, upon the hit or after the hit in addition to the simple flexion feeling for the individual player and this vibration remarkably affect the use feeling. Furthermore, the vibration of the shaft portion before the hit, of course, leads to the energy loss.

SUMMARY OF THE INVENTION

Accordingly, an object of the present invention is to provide an adjusting tool for suppressing vibration of a shaft portion, and to provide an adjusting method for determining an optimum mounting position of the adjusting tool in correspondence with a club used by an individual player.

According to a first aspect of the present invention, there is provided with a golf club adjusting tool for adjusting feeling of a golf club in use, characterized by comprising: a fixed portion coupled and fixed in contact with a shaft portion of the golf club in the contact range of 5 to 40 mm in a longitudinal direction; and a vibration absorbing portion projecting in the longitudinal direction of the shaft portion continuously with the fixed portion and out of contact with the shaft portion.

In a golf club adjusting tool according to the first aspect of the invention, according to a second aspect, a tip end portion of the vibration absorbing portion is adapted to be temporarily in contact with the shaft portion upon a shot.

In a golf club adjusting tool according to the first aspect of the invention, according to a third aspect, the fixed portion has such a size that the fixed portion is coupled around an outer circumferential surface of the shaft portion, and a vibration absorbing portion having a larger diameter of that of the fixed portion is provided to project from at least one of both ends of the fixed portion.

In a golf club adjusting tool according to the second aspect of the invention, according to a fourth aspect, the fixed portion has such a size that the fixed portion is coupled around an outer circumferential surface of the shaft portion, and a vibration absorbing portion having a larger diameter of that of the fixed portion is provided to project from at least one of both ends of the fixed portion.

In a golf club adjusting tool according to the first aspect of the invention, according to a fifth aspect, the fixed portion and the vibration absorbing portion are formed of cylindrical members made of metal and provided with associated radial direction stepped portions and first slits passing in the longitudinal direction through the metal made cylindrical members and second slits for dividing the fixed portion into a plurality of longitudinal segments in the longitudinal direction are provided in the metal made cylindrical members.

In a golf club adjusting tool according to the second aspect of the invention, according to a sixth aspect, the fixed portion and the vibration absorbing portion are formed of cylindrical members made of metal and provided with associated radial direction stepped portions and first slits passing in the longitudinal direction through the metal made cylindrical members and second slits for dividing the fixed portion into a plurality of longitudinal segments in the longitudinal direction are provided in the metal made cylindrical members, In a golf club adjusting tool according to the third aspect of the invention, according to a seventh aspect, the fixed portion and the vibration absorbing portion are formed of cylindrical members made of metal and provided with associated radial direction stepped portions and first slits passing in the longitudinal direction through the metal made cylindrical members and second slits for dividing the fixed portion into a plurality of longitudinal segments in the longitudinal direction are provided in the metal made cylindrical members.

In a golf club adjusting tool according to the fourth aspect of the invention, according to an eighth aspect, the fixed portion and the vibration absorbing portion are formed of cylindrical members made of metal and provided with associated radial direction stepped portions and first slits passing in the longitudinal direction through the metal made cylindrical members and second slits for dividing the fixed portion into a plurality of longitudinal segments in the longitudinal direction are provided in the metal made cylindrical members.

In a golf club adjusting tool according to the first aspect of the invention, according to a ninth aspect, the fixed portion has such a size that the fixed portion is coupled around an inner circumferential surface of the shaft and a vibration absorbing portion having a smaller diameter than that of the fixed portion is adapted to project from at least one of both ends of the fixed portion.

In a golf club adjusting tool according to the second aspect of the invention, according to a tenth aspect, the fixed portion has such a size that the fixed portion is coupled around an inner circumferential surface of the shaft and a vibration absorbing portion having a smaller diameter than that of the fixed portion is adapted to project from at least one of both ends of the fixed portion.

In a golf club adjusting tool according to the fifth aspect of the invention, according to an eleventh aspect, the fixed portion has such a size that the fixed portion is coupled around an inner circumferential surface of the shaft and a vibration absorbing portion having a smaller diameter than that of the fixed portion is adapted to project from at least one of both ends of the fixed portion.

In a golf club adjusting tool according to the sixth aspect of the invention, according to a twelfth aspect, the fixed portion has such a size that the fixed portion is coupled around an inner circumferential surface of the shaft and a vibration absorbing portion having a smaller diameter than that of the fixed portion is adapted to project from at least one of both ends of the fixed portion.

In a golf club adjusting tool according to the first aspect of the invention, according to a thirteenth aspect, the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

In a golf club adjusting tool according to the second aspect of the invention, according to a fourteenth aspect, the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

In a golf club adjusting tool according to the third aspect of the invention, according to a fifteenth aspect, the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

In a golf club adjusting tool according to the fourth aspect of the invention, according to a sixteenth aspect, the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

In a golf club adjusting tool according to the first aspect of the invention, according to a seventeenth aspect, a suitable cushioning member is interposed between the vibration absorbing portion and the shaft.

In a golf club adjusting tool according to the third aspect of the invention, according to an eighteenth aspect, a suitable cushioning member is interposed between the vibration absorbing portion and the shaft.

In a golf club adjusting tool according to the fifth aspect of the invention, according to a nineteenth aspect, a suitable cushioning member is interposed between the vibration absorbing portion and the shaft.

In a golf club adjusting tool according to the seventh aspect of the invention, according to a twentieth aspect, a suitable cushioning member is interposed between the vibration absorbing portion and the shaft.

In a golf club adjusting tool according to the ninth aspect of the invention, according to a twenty-first aspect, a suitable cushioning member is interposed between the vibration absorbing portion and the shaft.

In a golf club adjusting tool according to the eleventh aspect of the invention, according to a twenty-second aspect, a suitable cushioning member is interposed between the vibration absorbing portion and the shaft.

In a golf club adjusting tool according to the thirteenth aspect of the invention, according to a twenty-third aspect, a suitable cushioning member is interposed between the vibration absorbing portion and the shaft.

In a golf club adjusting tool according to the fifteenth aspect of the invention, according to a twenty-fourth aspect, a suitable cushioning member is interposed between the vibration absorbing portion and the shaft.

According to a twenty-fifth aspect of the invention, there is provided a golf club adjusting tool for adjusting feeling of a golf club in use, characterized by comprising: a fixed portion coupled and fixed around an outer circumferential surface of a shaft portion of the golf club in contact with the shaft portion in the contact range of 5 to 40 mm in a longitudinal direction; and a vibration absorbing portion having a larger diameter than that of the fixed portion and projecting in the longitudinal direction of the shaft portion continuously with one end portion of the fixed portion and out of contact with the shaft portion, wherein a tip end portion of the vibration absorbing portion is adapted to be temporarily in contact with the shaft portion upon a shot, and the fixed portion and the vibration absorbing portion are formed of cylindrical members made of metal and provided with associated radial direction stepped portions and first slits passing in the longitudinal direction through the metal made cylindrical members and second slits for dividing the fixed portion into a plurality of longitudinal segments in the longitudinal direction are provided in the metal made cylindrical members.

According to a twenty-sixth aspect of the invention, there is provided a golf club adjusting tool for adjusting feeling of a golf club in use, characterized by comprising: a fixed portion coupled and fixed around an outer circumferential surface of a shaft portion of the golf club in contact with the shaft portion in the contact range of 5 to 40 mm in a longitudinal direction; and a vibration absorbing portion having a larger diameter than that of the fixed portion and projecting in the longitudinal direction of the shaft portion continuously with both end portions of the fixed portion and out of contact with the shaft portion, wherein a tip end portion of the vibration absorbing portion is adapted to be temporarily in contact with the shaft portion upon a shot, and the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

According to a twenty-seventh aspect of the invention, there is provided a golf club adjusting tool for adjusting feeling of a golf club in use, characterized by comprising: a fixed portion coupled and fixed around an outer circumferential surface of a shaft portion of the golf club in contact with the shaft portion in the contact range of 5 to 40 mm in a longitudinal direction; and a vibration absorbing portion having a larger diameter than that of the fixed portion and projecting in the longitudinal direction of the shaft portion continuously with one end portion of the fixed portion and out of contact with the shaft portion, wherein a suitable cushioning member is interposed between the vibration absorbing portion and the shaft, and the fixed portion and the vibration absorbing portion are formed of cylindrical members made of metal and provided with associated radial direction stepped portions and vibration absorbing portion slits for dividing the vibration absorbing portion into a plurality of longitudinal segments in the longitudinal direction in a portion constituting the vibration absorbing portion are provided in the metal made cylindrical members.

According to a twenty-eighth aspect of the invention, there is provided a golf club adjusting tool for adjusting feeling of a golf club in use, characterized by comprising: a fixed portion coupled and fixed around an inner circumferential surface of a shaft portion of the golf club in contact with the shaft portion in the contact range of 5 to 40 mm in a longitudinal direction; and a vibration absorbing portion having a smaller diameter than that of the fixed portion and projecting in the longitudinal direction of the shaft portion continuously with both end portions of the fixed portion and out of contact with the shaft portion, wherein a tip end portion of the vibration absorbing portion is adapted to be temporarily in contact with the shaft portion upon a shot, and the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

Also, according to a twenty-ninth aspect of the invention, there is provided a golf club adjusting tool for adjusting feeling of a golf club in use, characterized by comprising: a fixed portion coupled and fixed around an inner circumferential surface of a shaft portion of the golf club in contact with the shaft portion in the contact range of 5 to 40 mm in a longitudinal direction; and a vibration absorbing portion having a smaller diameter than that of the fixed portion and projecting in the longitudinal direction of the shaft portion continuously with one end portion of the fixed portion and out of contact with the shaft portion, wherein a tip end portion of the vibration absorbing portion is adapted to be temporarily in contact with the shaft portion upon a shot, and the fixed portion and the vibration absorbing portion are formed of cylindrical members made of metal and provided with associated radial direction stepped portions and mounting slits passing in the longitudinal direction through the metal made cylindrical members and vibration absorbing portion slits for dividing the vibration absorbing portion into a plurality of longitudinal segments in the longitudinal direction in a portion constituting the vibration absorbing portion are provided in the metal made cylindrical members.

According to a thirtieth aspect of the present invention, there is provided a golf club characterized in that the golf club is provided at a suitable position of a shaft portion of the golf club with the golf club adjusting tool according to any one aspect of the first to twenty-ninth aspects of the invention.

According to a thirty-first aspect of the invention, there is provided a golf club adjusting method for mounting, at a suitable number of mounting positions of a shaft portion of the golf club, a test tool for pressingly fixing the shaft portion at a contact portion having a length in the range of 5 to 40 mm for test shot for detecting an optimum mounting position for the player for determining a mounting position of the golf club adjusting club according to any one of the first to twenty-ninth aspects of the invention.

In the golf club on which the adjusting tool has been mounted, when the vibration is generated in the shaft portion, the vibration absorbing portion is vibrated through the fixed portion independently of the shaft portion vibration to attenuate the shaft portion vibration. Accordingly, the shaft portion vibration is suppressed for a short period of time to eliminate the vibration per se.

Furthermore, when the tip end portion of the vibration absorbing portion is brought into temporary contact with the shaft portion upon the shot, the repulsive force of the vibration absorbing portion becomes a force upon the return flex of the shaft portion, i.e., a so-called returning force to thereby increase the repulsive force of the shaft portion.

Also, since the fine adjustment of the adjusting tool mounting position according to the feeling in use for an individual player such as the extent of the attenuation of vibration and the flex or rigidity characteristics of the shaft portion is required, the optimum position of the feeling in use is determined by repeating the test hits while changing the mounting position of the test tool for the golf club to be used or bought by the individual player, and the tool is mounted at the optimum position to obtain the golf club which is provided with the shaft performance corresponding to the taste of the player.

DESCRIPTION OF THE PREFERRED EMBODIMENTS

Figure 1A:
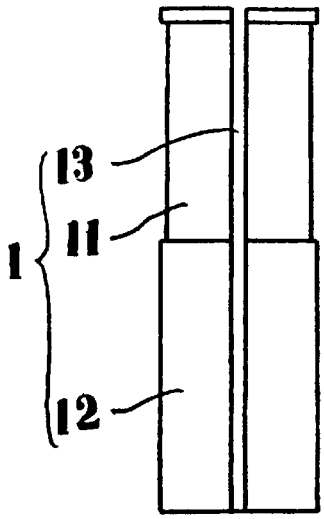
FIG. 1A is a frontal view of a golf club adjusting tool according to a first embodiment of the invention.
Figure 1B:
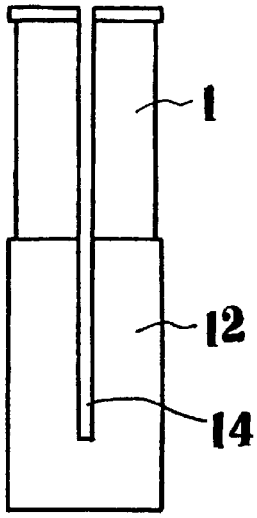
FIG. 1B is a side elevational view of a golf club adjusting tool according to the first embodiment of the invention.
Figure 1C:
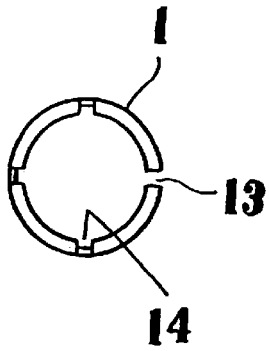
FIG. 1C is a plan view of a golf club adjusting tool according to the first embodiment of the invention.
Figure 2:
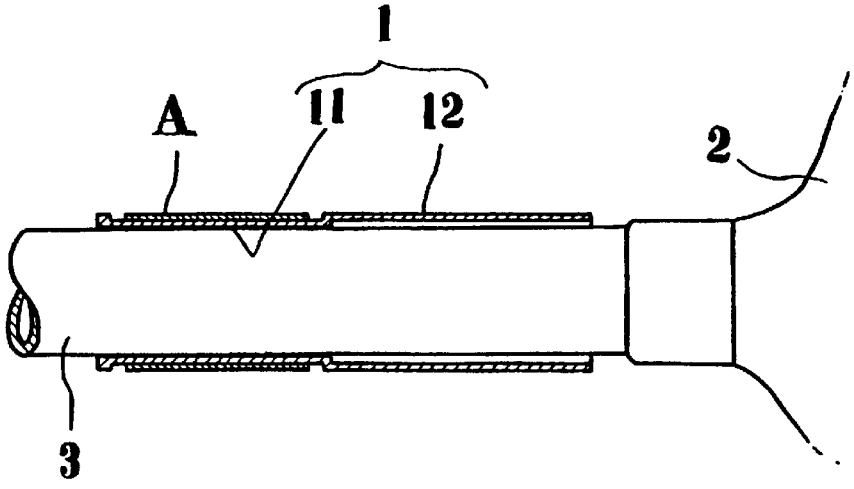
FIG. 2 is an illustration of a state where the tool according to the first embodiment is mounted.

A preferred embodiment of the present invention will now be described with reference to the accompanying drawings.

First of all, a first embodiment will be described. The first embodiment is directed to an adjusting tool to be mounted on an outer portion of a shaft portion.

FIGS. 1A, 1B and 1C and FIG. 2 show a first example of the first embodiment of the adjusting tool 1 according to the present invention. The adjusting tool 1 according to this embodiment is used to be mounted on a so-called socket portion that is a joint portion between a head portion 2 and a shaft portion 3 of a golf club.

The adjusting tool 1 is a cylindrical member made of metal or resin. For example, a special duralumin alloy is ground to form a stepped cylindrical member having a small diameter portion (fixed portion) 11 that may be fit around an outer circumferential surface of the shaft portion 3 with a length of 5 to 20 mm (the most preferable range is in the range of 12 to 15 mm, and in case of resin, the range is not greater than 40 mm which range is longer than that of the metal made one) and a large diameter portion (vibration absorbing portion) 12 having a length 10 to 30 mm and continuous with one end of the small diameter portion 11. Then, a first slit 13 for mounting which passes through the overall cylindrical member in the longitudinal direction is formed in the cylindrical member. Furthermore, in the small diameter portion (fixed portion) 11, second slits 14 for mounting are provided for suitably dividing the small diameter portion 11 into a suitable number of vertical segments from the end portion to the stepped portion (in the figures, to the vicinity of the end of the large diameter portion 12).

The above-described adjusting tool 1 is mounted around the outer circumferential surface of the socket portion of the shaft portion 3 with the large diameter portion (vibration absorbing portion) 12 on the side of the head portion 2. The fixture of this adjusting tool 1 may be performed by winding tape A around the outer circumferential surface of the small diameter portion (fixed portion) 11 or by winding adhesive tape around the inner circumferential surface of the fixed portion 11.

In particular, it is possible to wind with ease the adjusting tool 1 around the shaft portion 3 by largely opening the first mounting slit 13 upon the above-described mounting operation, and furthermore, it is possible to mount the fixed portion 11 as a whole around the outer circumferential surface of the shaft portion 3 by the second mounting slits 14. Accordingly, it is possible to normally fix and mount the adjusting tool 1.

When the player hits a ball with the golf club on which the adjusting tool 1 is affixedly mounted, vibration occurs in the shaft portion 3 due to the flexion of the shaft 3 and the weight of the head portion 2 when the club is swung back and swung down before the hit. However, in this case, if the vibration absorbing portion 12 that is out of the contact with the shaft portion 3 is swung corresponding to the vibration of the shaft portion 3 and is out of the resonant condition, the vibration absorbing portion 12 exhibits the effect for suppressing (attenuating) the shaft vibration.

Accordingly, the swing of the head portion 2 upon the hit is suppressed to enhance the hit efficiency, as a result of which a drive distance is extended and direction characteristics may be stabilized. Furthermore, also the vibration of the shaft portion 3 after the shot is attenuated earlier by the vibration of the vibration absorbing portion 12, and the hand feeling may be enhanced.

Figure 3:
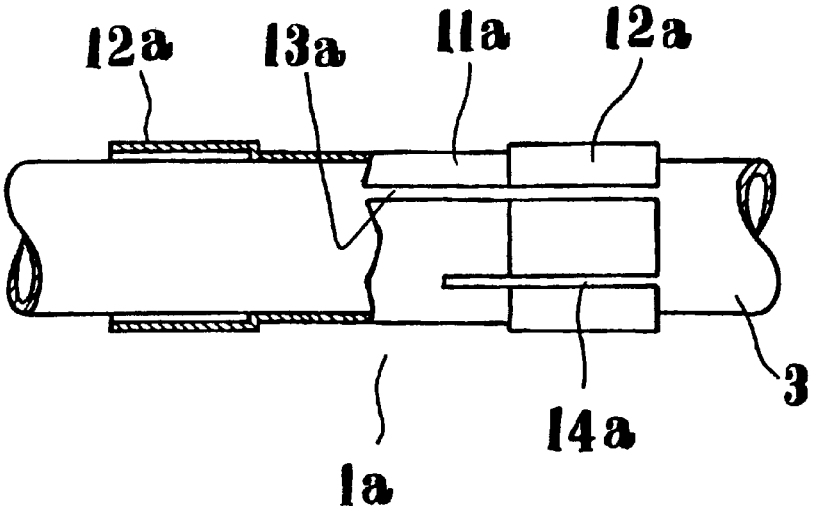
FIG. 3 is an illustration of a state where a tool according to a second embodiment is mounted.

Also, FIG. 3 shows a second example of the first embodiment. The adjusting tool 1*a* according to the second example adopts a metal cylindrical member in the same manner as in the first example. The vibration absorbing portions 12*a* are provided on both ends of the small diameter portion (fixed portion) 11*a* of the cylindrical member (adjusting member) 1*a*. The mounting slit 13*a* is formed through the cylindrical member 1*a* as a whole in the longitudinal direction. Furthermore, in the large diameter portion (vibration absorbing portion) 12*a*, the vibration absorbing portion slits 14*a* are provided for suitably dividing the small diameter portion 11*a* into a plurality of vertical segments from the end portion to the stepped portion (in the figures, to the vicinity of the end of the large diameter portion 12).

If the fixed portion 11*a* of the above described adjusting tool 1*a* is integrally fixed to a suitable position of the outer circumferential surface of the shaft portion 3 by using adhesives, the vibration of the shaft portion 3 causes the vibration absorbing portion 12*a* to vibrate through the fixed portion 11*a* in the same manner as in the first example, and the vibration of the vibration absorbing portion 12*a* attenuates the vibration of the shaft portion 3.

Figure 4:
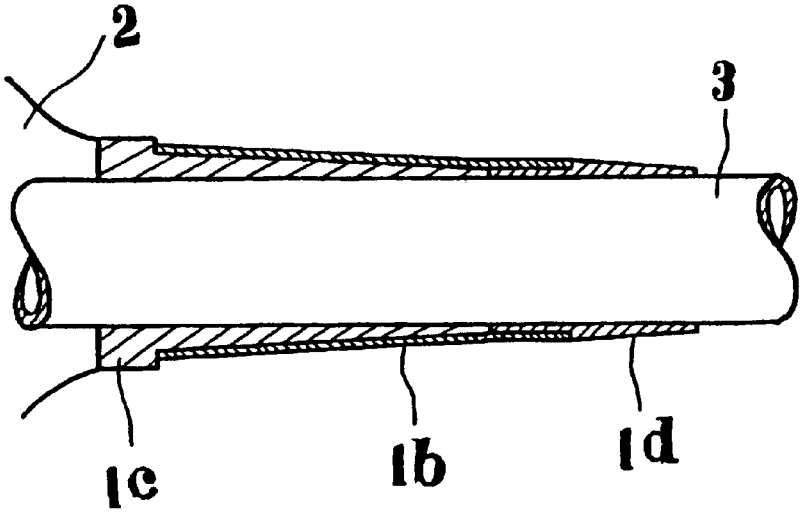
FIG. 4 is an illustration of a state where a tool according to a third embodiment is mounted
Figure 5:
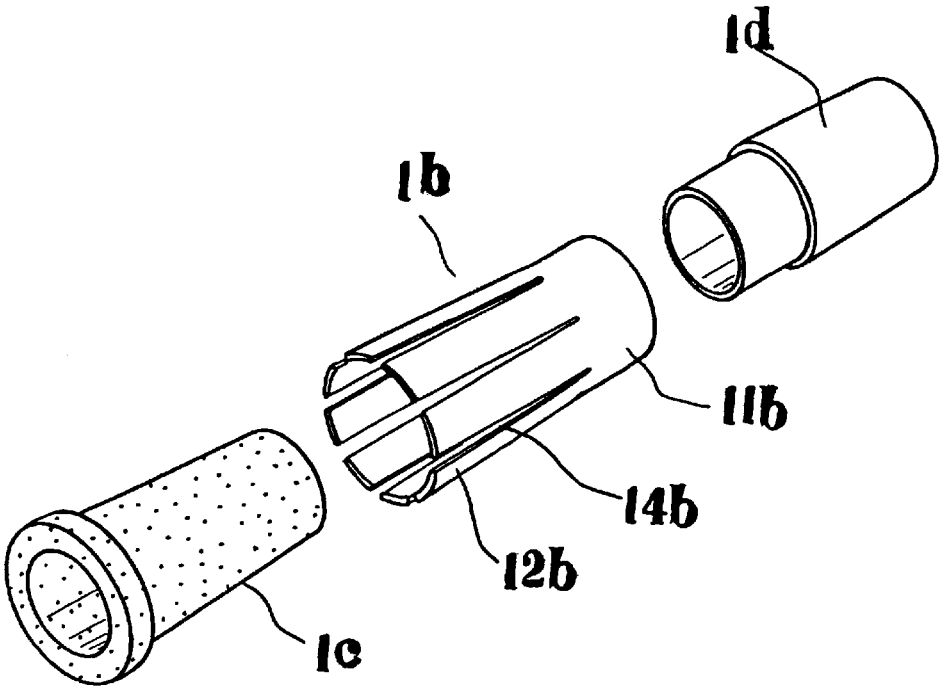
FIG. 5 is an exploded perspective view of the tool according to the third embodiment.

FIGS. 4 and 5 shows a third example of the first embodiment and shows an adjusting tool 1*b* applied particularly to the joint portion between the head portion 2 and the shaft portion 3. This adjusting tool 1*b* is mounted on the shaft portion 3 further in combination with a cushioning member 1*c* and a flange member 1*d*.

The three components are adapted to form a conical circumferential shape so that the tool may smoothly move from the head portion 2 to the outer circumferential surface of the shaft portion 3 when the three components are mounted in combination together.

The adjusting tool 1*b* is formed into the cylindrical member having the above-described conical circumferential shape. The adjusting tool 1*b* has a fixed portion 11*b* at its proximal end portion. A large diameter portion that is expanded gradually is formed as the vibration absorbing portion 12*b* and is provide with vibration absorbing portion slits 14*b* for suitably separating vertically.

The cushioning member 1*c* is used to fill the space between the vibration absorbing portion 12*b* and the shaft portion 3 to prevent any foreign matter from entering the space inside of the vibration absorbing portion 12*b* and also exhibits the effect of accelerating the vibration attenuation.

The flange member 1*d* is provided with a conical circumferential portion (exposed portion) transiting from the head portion 2 to the shaft portion 3 and a portion (inserted portion) located inside of the above-described fixed portion (proximal portion) 11*b* with a height of a stepped portion between the two portions corresponding to the thickness of the fixed portion 11*b*.

The cushioning member 1*c* is mounted on the shaft portion 3 continuous with the head portion 2. At the same time, the cushioning member 1*c* is covered by the adjusting tool 1*b*, and furthermore, the proximal portion (fixed portion) 11*b* is fixed to the outer circumference of the inserted portion of the flange member 1*d* fixed to the shaft portion 3.

Also, according to this third example, the attenuation of the vibration of the shaft may be performed by the adjusting tool 1*b* in the same manner as in the foregoing examples.

A second embodiment will now be described. The second embodiment is directed to an adjusting tool to be mounted on an inner surface of the shaft portion 3.

Figure 6:
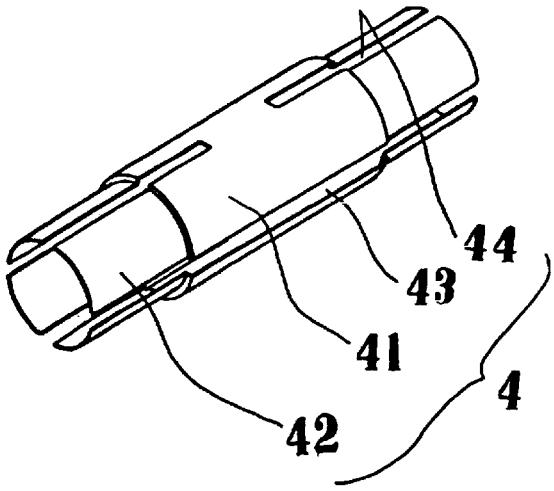
FIG. 6 is an overall perspective view of a tool according to a fourth embodiment.
Figure 7:
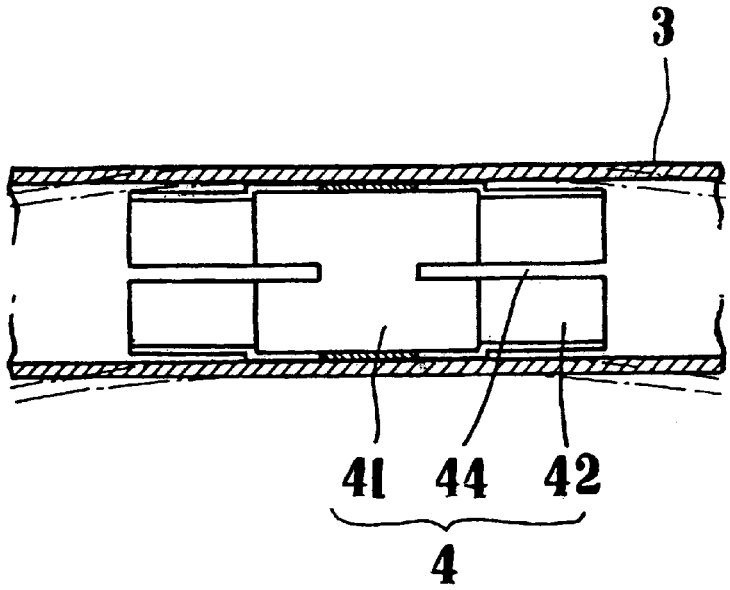
FIG. 7 is an illustration of a state where the tool according to the fourth embodiment is mounted.

FIGS. 6 and 7 show an embodiment (fourth example) of the second embodiment.

An adjusting tool 4 is formed of a cylindrical member made of metal or resin in the same manner as in the adjusting tool 1 according to the first embodiment. In the case of the metal, this cylindrical member is formed into a stepped cylindrical member having a large diameter portion (fixed portion) 41 that may be fit around an inner circumferential surface of the shaft portion 3 with a length of 8 to 20 mm (the most preferable range is in the range of 12 to 15 mm, and in case of resin, the range is longer in the same manner as in the first embodiment) and a small diameter portion (vibration absorbing portion) 42 having a length 10 to 30 mm and continuous with both ends of the large diameter portion 41.

Furthermore, in the above-described cylindrical member, mounting slit 43 for passing through the cylindrical member as a whole in the longitudinal direction is provided and at the same time, vibration absorbing portion slits 44 are provided for dividing vertically the small diameter portion 42 suitably from each end portion of the small diameter portion (vibration absorbing portion) 42 to the stepped portion (in the figures, to the vicinity of the middle of the large diameter portion 41).

The above-described adjusting tool 4 is inserted at a suitable position within the shaft portion 3 (normally in the intermediate portion or somewhat closer to the tip end portion than the intermediate portion). Its detailed positioning is determined by the use of the test tool 5 to be described later. The tool is adapted to fix the large diameter portion (fixed portion) 41 to the inner surface of the shaft portion 3. Incidentally, if the adjusting tool 4 is pressed and inserted to be thin by the mounting slits 43 and is left at the position where the adhesives are applied in advance, it is possible to intimately fix the tool to the desired position by the opening resilient force of the adjusting tool 4 per se.

In the club in which the above-described adjusting tool 4 is mounted internally on the shaft portion 3, the flexion of the shaft portion 3 during the swing is changed by the fixed portion 41 of the adjusting tool 4. Namely, if the shaft portion 3 is to be flexed by the swing motion, the flexion per se is to be suppressed by the adjusting tool 44. The extent of the suppression is determined by the flexibility strength of the adjusting tool 4 per se (a material, a dimension, i.e., a thickness and a length of the adjusting tool).

Furthermore, since the adjusting tool 4 is provided with the small diameter portion (vibration absorbing portion) 42, the vibration of the shaft portion 3 generated during the swing is attenuated by the vibration of the small diameter portion (vibration absorbing portion) 42 in the same manner as in the above-described first embodiment, and the fine vibration of the head portion 2 upon the hit is suppressed in the same manner as in the first embodiment, which leads to the superiority in hit efficiency to extend the driving distance and to stabilize the driving direction.

In the above-described adjusting tool 4, a size of the diameter of the small diameter portion (vibration absorbing portion) 42 is suitably selected so that the small diameter portion (vibration absorbing portion) 42 is brought into contact with the inner circumferential surface of the shaft portion 3 upon the flexion of the shaft portion 3 or the small diameter portion is not brought into contact with the inner circumferential surface at all. This may be selected by a taste of the individual player.

Namely, when the tip end of the small diameter portion (vibration absorbing portion) 42 is brought into contact with the shaft portion 3 upon the flexion of the shaft portion 3, the small diameter portion (vibration absorbing portion) 42 is affected by the shaft portion 3. Accordingly, the repulsive force by this affect becomes a force (repulsive force) upon the return flexion of the shaft portion 3 to increase the repulsive force of the shaft. Incidentally, it goes without saying that the force works as the vibration attenuating force not only in the non-contact condition but also in the contact condition.

Figure 8:
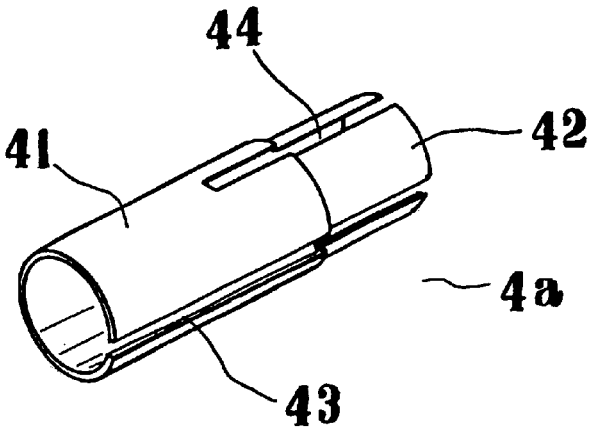
FIG. 8 is an overall perspective view of a tool according to a fifth embodiment.

Incidentally, as shown in a fifth example of the second embodiment in FIG. 8, it is possible to provide an adjusting tool 4*a* where the vibration absorbing portion 42 is provided only at the one end of the fixed portion 41.

By the way, since the flexion characteristics of the shaft portion 3 are changed at the mounting positions of the above-described adjusting tools 1, 1*a*, 1*b*, 4 and 4*b*, it is necessary to mount and fix the adjusting tools 1, 1*a*, 1*b*, 4, and 4*b* at the suitable position based upon the individual player's feeling. Accordingly, an adjusting method for determining the mounting position of the adjusting tools 1, 1*a*, 1*b*, 4 and 4*b* is proposed.

Figure 9:
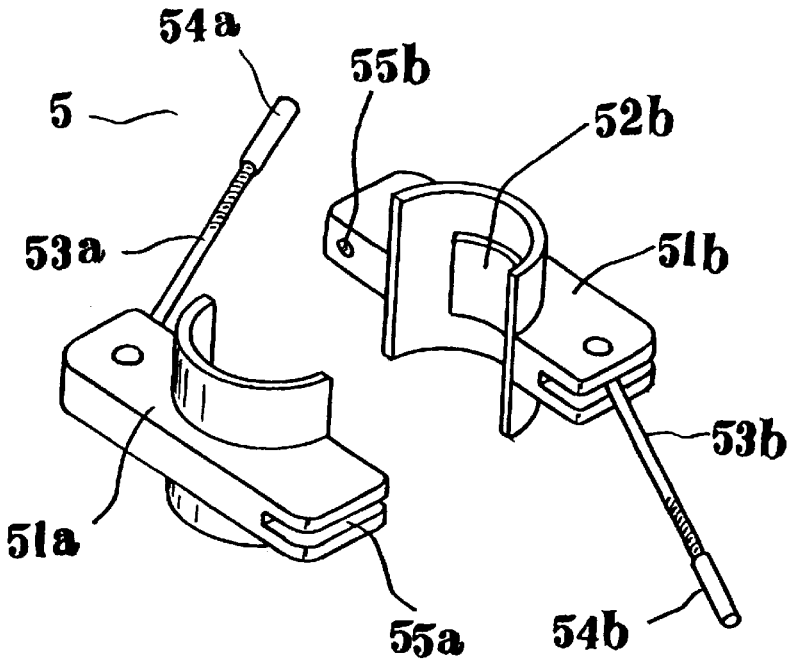
FIG. 9 is an exploded perspective view of a test tool 5.
Figure 10:
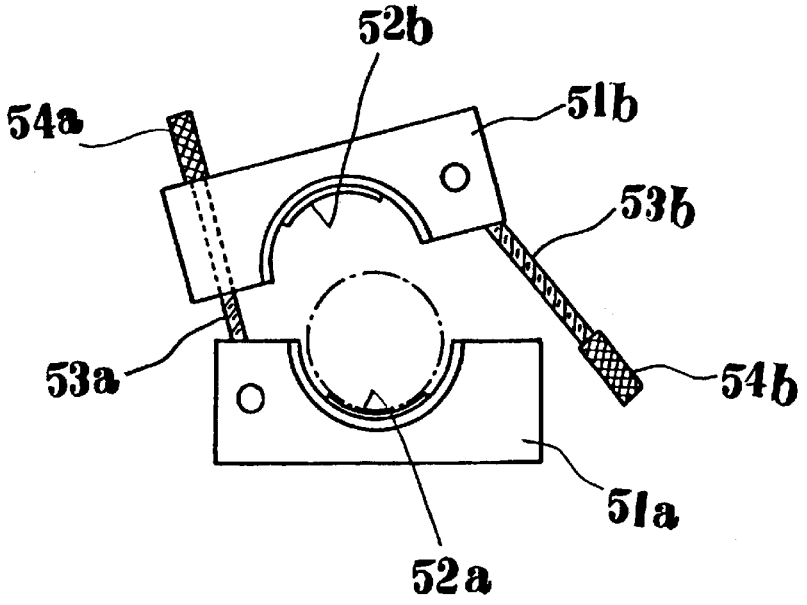
FIG. 10 is an illustration of a state where the test tool 5 is used.

A test tool 5 used in the adjusting method is that shown in FIGS. 9 and 10. The test tool 5 shown is composed of two clamp members 51*a* and 51*b*.

The clamp members 51*a* and 51*b* are provided symmetrically. Curved recess portions are provided on the facing surfaces. The contact projecting portions (contact portion) 52*a*, 52*b* having a length in the range of 8 to 20 mm in the same manner as that of the fixed portion of the above-described adjusting tool (the optimum range is 12 to 15 mm) are provided on the recess portion surfaces. This range is for the case of the metal. In the case of resin, the range is the same as in the first embodiment and the second embodiment. Furthermore, the two clamp members are provided with fastening screw rods 53*a* and 53*b* fixing the proximal portions at one end portions and fastening nuts 54*a* and 54*b* threadedly engaging the fastening screws. A mounting groove 55*a* that may be mounted from the outside on the fastening screw 53*b* of the other clamp member 51*b* is provided on the opposite side to the pivot coupling side of the fastening screw of the clamp member 51*a*, and a mounting hole 55*a* is formed in the clamp member 51*b*.

The fastening screw 53*a* of the clamp member 51*a* is inserted into the mounting hole 55*b* of the other clamp member 51*b* to combine the clamp members 51*a* and 51*b* openably. The clamp members 51*a* and 51*b* are coupled together in a desired position of the shaft portion 3. The fastening screw 53*b* is inserted into the mounting groove 55*a* and the respective fastening nuts 54*a* and 54*b* are threadedly fastened. As a result, the shaft portion 3 is clamped and fixed only by the contact projections 52*a* and 52*b*. Then, the user of the golf club may be allowed to make a test shot.

The test shots are repeated by changing the mounting positions of the test tool 5 to thereby detect the optimum position for the user and to determine the mounting position of the above-described adjusting tools 1, 1*a*, 1*b*, 4 and 4*b*.

Accordingly, if the mounting position of the adjusting tools 1, 1*a*, 1*b*, 4 and 4*b* is determined and the adjusting tool 1, 1*a*, 1*b*, 4 or 4*b* is mounted, it is possible to provide a golf club that may exhibit the function of the adjusting tool 1, 1*a*, 1*b*, 4 or 4*b* depending upon the taste of the user.

According to the present invention, with the golf club adjusting tool for adjusting feeling of a golf club in use, characterized by comprising: a fixed portion coupled and fixed in contact with a shaft portion of the golf club in the contact range of 5 to 40 mm in a longitudinal direction; and a vibration absorbing portion projecting in the longitudinal direction of the shaft portion continuously with the fixed portion and out of contact with the shaft portion, it is possible to provide a golf club in which the attenuating ability of the shaft vibration is enhanced, and the directionability or the driving distance of the golf club is enhanced with a shaft performance corresponding to the taste of the player.

What is claimed is:

1. A golf club adjusting tool for adjusting feeling of a golf club in use, comprising:

a cylindrical fixed portion;

a vibration absorbing portion extending from a first end of the fixed portion, the vibration absorbing portion having at least one vibration absorbing portion slit extending along its length;

the fixed portion is of larger diameter than the vibration absorbing portion;

a radial step portion is located between the cylindrical fixed portion and the vibration absorbing portion; and the at least one vibration absorbing portion slit is a plurality of slits.

2. The golf club adjusting tool of claim 1, wherein the fixed portion has at least one mounting slit extending along its entire length.

3. The golf club adjusting tool of claim 2, wherein the at least vibration absorbing portion slit in the vibration absorbing portion is continuous with a one mounting slit of the fixed portion.

4. The golf club adjusting tool of claim 1, comprising;

a second vibration absorbing portion extending from a second end the fixed portion, the second vibration absorbing portion being of smaller diameter than the fixed portion.

5. The golf club adjusting tool of claim 4, wherein the second vibration absorbing portion has at least one vibration absorbing portion slit extending along its length.

6. The golf club adjusting tool of claim 5, wherein the vibration absorbing portion slits in the first and second vibration absorbing portions are a plurality of slits.

7. The golf club adjusting tool of claim 1, wherein the cylindrical fixed portion and the vibration absorbing portion are made of either metal or resin.

8. The golf club adjusting tool of claim 1, wherein a mounting slit extends along the entire length of the tool.

* * * * *

UNITED STATES PATENT AND TRADEMARK OFFICE

CERTIFICATE OF CORRECTION

PATENT NO. : 6,755,752 B2
DATED : June 29, 2004
INVENTOR(S) : Sadatsugu Shimizu et al.

It is certified that error appears in the above-identified patent and that said Letters Patent is hereby corrected as shown below:

Title page,
Item [74], *Attorney, Agent, or Firm*, should read -- Connolly Bove Lodge & Hutz LLP --

Column 12,
Lines 11-14, Claim 3, should read:

-- The golf club adjusting tool of claim 2, wherein a vibration absorbing portion slit in the vibration absorbing portion is continuous with the at least one mounting slit of the fixed portion. --

Signed and Sealed this

Twenty-eighth Day of December, 2004

JON W. DUDAS
*Director of the United States Patent and Trademark Office*